United States Patent [19]

Burton, III

[11] 3,990,835

[45] Nov. 9, 1976

[54] BURNER FOR IGNITING OIL SHALE RETORT

[75] Inventor: Robert S. Burton, III, Grand Junction, Colo.

[73] Assignee: Occidental Petroleum Corporation, Los Angeles, Calif.

[22] Filed: July 26, 1974

[21] Appl. No.: 492,600

[52] U.S. Cl. ..... 431/353; 431/79; 431/183; 431/158; 175/12

[51] Int. Cl.[2] ..... F23D 15/02

[58] Field of Search ..... 431/353, 79, 158, 263, 431/183, 202; 175/14, 11, 12

[56] References Cited

UNITED STATES PATENTS

| | | | |
|---|---|---|---|
| 2,572,338 | 10/1951 | Hartwig et al. | 431/158 |
| 2,688,464 | 9/1954 | Payne | 175/12 |
| 2,958,194 | 11/1960 | Bayley | 431/158 |
| 3,042,105 | 7/1962 | Bitterlich | 431/353 |
| 3,045,766 | 7/1962 | Fleming, Jr. | 431/158 |
| 3,187,799 | 6/1965 | Nesbitt | 431/353 |
| 3,299,841 | 1/1967 | Hemker et al. | 431/183 |
| 3,324,926 | 6/1967 | Jakobi | 431/79 |
| 3,385,527 | 5/1968 | Drewry | 431/263 |
| 3,395,005 | 7/1968 | Stelmah | 431/158 |

*Primary Examiner*—William F. O'Dea
*Assistant Examiner*—Henry C. Yuen
*Attorney, Agent, or Firm*—Christie, Parker & Hale

[57] ABSTRACT

A technique is described for igniting the oil shale rubble pile in an in situ oil shale retort. A gas-air burner is lowered through a hole to a plenum over the oil shale to be ignited. An excess of air is passed through the hole and around the burner so that it is kept cool as the flame from it impinges on the rubble pile and the air also provides oxygen for combustion of carbonaceous material in the shale. Preferably the burner is in a cylindrical housing having a refractory exit nozzle at its lower end so that a hot flame is ejected downwardly. Air is brought to the inlet of the nozzle through an outer feed tube in the housing and coaxial therewith. Combustible gas is introduced through an inner axial feed tube which terminates short of the inlet end of the nozzle in a mixing chamber. A mixing orifice is provided between the mixing chamber and the nozzle for thorough mixing of the gas and inhibition of travel of the flame back into the burner. A pair of ignitors downstream from the orifice ignite the gas mixture and the presence of a flame is detected by an ultraviolet sensor mounted for viewing axially through the inner feed tube.

9 Claims, 5 Drawing Figures

BURNER FOR IGNITING OIL SHALE RETORT

BACKGROUND OF THE INVENTION

There are vast deposits of oil shale throughout the world with one of the larger deposits being in the Piceance basin of Colorado, Wyoming and Utah. This oil shale has carbonaceous materials known as kerogen which decompose on heating to produce shale oil which approximates crude petroleum. The vast oil shale deposits represent a very large source of oil for the world energy economy.

A variety of techniques have been proposed for extracting the shale oil at economical prices. Many of these techniques mine the oil shale by underground or open pit mining and carry it to large retorts where it is heated and the oil extracted. These approaches involve moving massive amounts of material to the retorts and disposing of enormous quantities of spent shale from which the carbonaceous values have been extracted.

Another approach which has significant economic advantages and minimal impact on the environment employs in situ retorting where the shale oil is removed without mining all of the oil shale. Such retorts can be formed, for example, by excavating a portion of rock in a volume that ultimately will become an underground retort. The balance of the rock in the volume to become a retort is then explosively expanded to form a rubble pile of oil shale particles substantially completely filling the retort volume. The original excavated volume is thus distributed through the expanded oil shale particles as the void volume therebetween.

Oil is then extracted from the expanded rubble pile in the underground retort by igniting the top of the rubble pile and passing an oxygen bearing gas, such as air, downwardly through the retort. Once raised to a sufficient temperature the oil shale will support combustion, initially at the top of the retort by burning some of the oil in the shale. Thereafter, as the oil is extracted there is residual carbon left in the shale and, when at a sufficient temperature, this too will react to oxygen to burn and supply heat for retorting. This burning of residual carbon in the shale depletes oxygen from the air being passed down through the retort and the substantially inert gas then carries heat to a retorting zone below the combustion zone for decomposing the kerogen and extracting oil. Gasses from the bottom of the retort are collected and often contain sufficient hydrogen, carbon monoxide and/or hydrocarbons to be burnable in heat engines. Oil is also collected at the bottom of the retort and transported for conventional refining.

When the oil shale is expanded in the underground retort, the particles ordinarily fill the entire volume so that there is no significant void space above the rubble pile. Air for combustion can be brought to the rubble pile by means of holes bored through overlying intact rock. Appreciable difficulty may be encountered, however, in igniting the top of the rubble pile to support combustion. Ignition requires a substantial amount of heat delivered over a sufficient time to raise the oil shale above its ignition temperature. Considerable difficulty is encountered in providing burners for such ignition and assuring that ignition has been obtained.

BRIEF SUMMARY OF THE INVENTION

There is, therefore, provided in practice of this invention according to a presently preferred embodiment, a gas-air burner in a cylindrical housing having a refractory nozzle at one end so that a flame exiting therefrom inpinges on oil shale in the rubble pile. Air and gas are brought in through an outer feed tube coaxial with the housing and communicating with the inlet end of the nozzle and an inner feed tube terminating in an open end spaced apart from the exit nozzle. A mixing chamber provides thorough mixing of the gas and air at the end of the inner feed tube and the mixed gas then passes through an orifice and past igniters enroute to the nozzle. A radiation sensitive flame sensor is mounted for viewing along the axis of the burner through the inner feed tube to verify that combustion is occurring in the burner.

DRAWINGS

These and other features and advantages of the present invention will be appreciated as the same becomes better understood by reference to the following detailed description of a presently preferred embodiment when considered in connection with the accompanying drawings wherein.

DESCRIPTION

Figure 1:
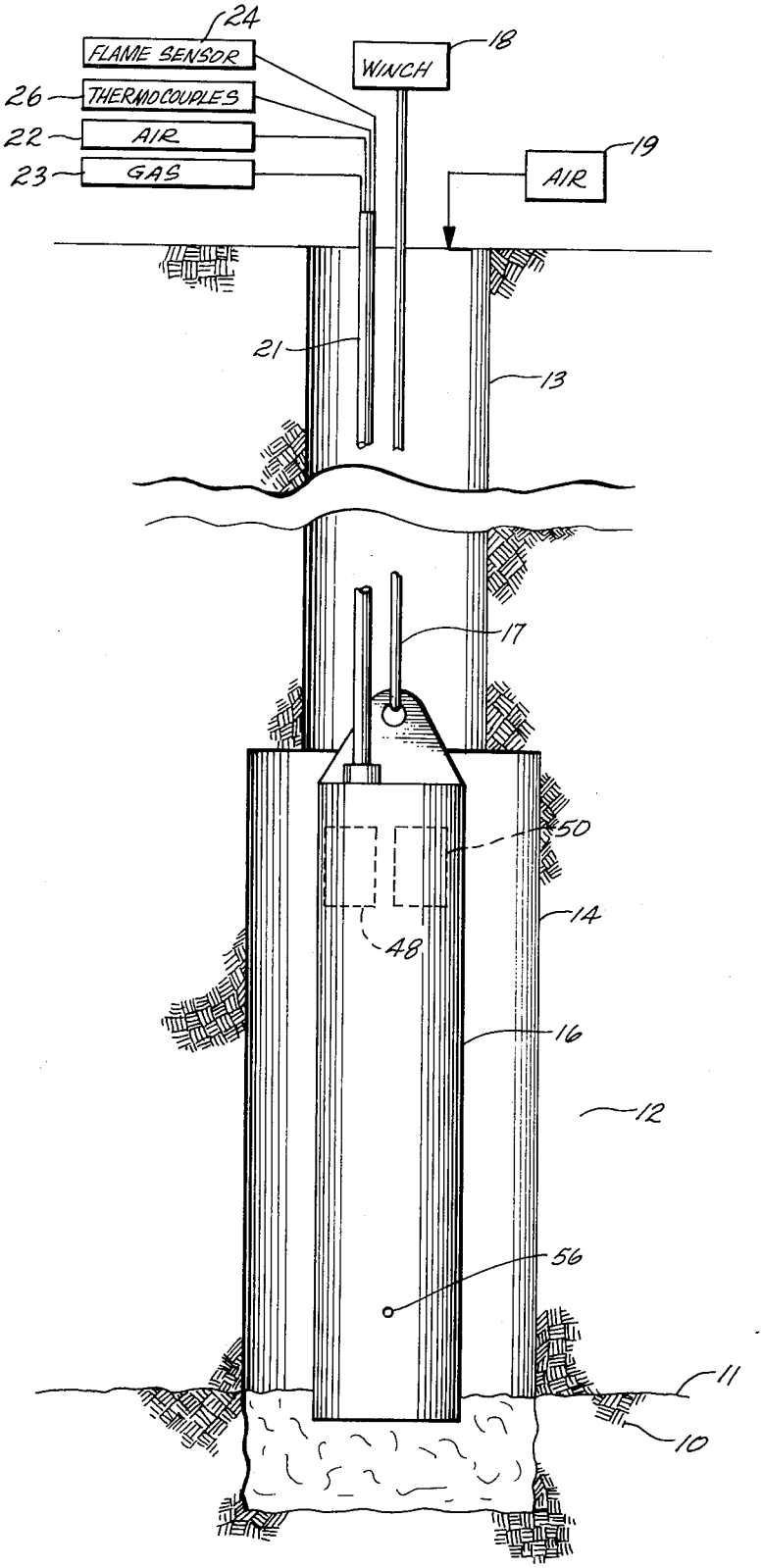
FIG. 1 illustrates in longitudinal cross section a burner constructed according to principles of this invention in place adjacent an oil shale rubble pile in an in situ retort.

FIG. 1 illustrates in vertical cross section and partly schematically a burner arrangement for igniting a rubble pile in an in situ oil shale retort. Only the very uppermost portion of the retort volume 10 is indicated in FIG. 1. This retort volume is simply cross-hatched as earth. However it will be understood that the volume is filled with irregularly-shaped particles of expanded oil shale, ordinarily fragmented by detonation of explosives. Above the ceiling 11 of the retort volume there is an overburden of intact rock 12. The thickness of this overburden is arbitrary and may be a few tens of feet in some retorting arrangements and may be hundreds of feet in others.

A cylindrical hole 13 is bored through the overburden 12 to the top of the rubble pile. This hole may be formed either before or after blasting to form the rubble pile of expanded shale, but is usually made subsequent to blasting. Such a hole may be made by conventional drilling techniques and reamed out to the desired size. If some or all of the over burden is permeable the hole may be cased with steel pipe or the like, and it is to be understood that reference herein to a hole includes either a simple bore through intact rock or a cased bore hole.

A larger diameter plenum 14 is formed at the lower end of the hole 13 with its lower end in communication with the top of the rubble pile. This plenum may extend below the ceiling 11 into the rubble for some distance, however, a principal portion of the plenum will ordinarily be formed in intact rock to assure that the plenum remains open. If a hole of any substantial height is formed in the rubble pile the irregular pieces of rock may collapse into the hole and block it. It is therefore, generally undesirable to form any great length of the plenum 14 in the rubble pile itself.

Such a plenum may be formed prior to blasting to form the rubble pile, however, the uncertainty that it will remain intact is such that it is preferable to form the plenum after blasting. If it is formed prior to blasting it should be inspected to assure that an appropriate plenum remains after blasting. The plenum is typically formed by lowering a conventional expanding underreamer or chambering tool down the hole 13 and reaming out an enlarged diameter. An appreciably enlarged plenum can be formed in this manner. For example, with a 10 inch diameter bore hole 13, a plenum in the range of 17 to 27 inches can be made with conventional tools. The length of height of the plenum need by only sufficient to accommodate a burner lowered therein and assure that particles of rubble do not sufficiently block the lower end of the plenum to inhibit the passage of combustion air therethrough.

After a suitable plenum is assured, a burner 16 is lowered down the hole by cable 17 connected to a winch 18 above the overburden. If desired, the burner can be lowered to a point that it is substantially completely in the plenum so that there is no obstruction of the hole 13 which would inhibit the passage of air therethrough. This is not necessarily required and if of small enough diameter, the upper portions of the burner can be in the hole 13 without unduly constricting air flow. Further, the quantity of air needed during ignition of the rubble pile may be less than needed during retorting thereof. Air is forced down the hole 13 into the rubble pile from any conventional blower or other air supply 19, indicated schematically in FIG. 1.

A "utility" umbilical 21 is connected to the burner 16 and extends up the hole 13 for operation of the burner. Compressed air 22 and a combustible gas 23 are fed down hoses in the umbilical for combustion in the burner. Propane, butane, natural gas, flue gas from oil shale retorting, or other combustible materials can conveniently be used. It will also be apparent, of course, that oxygen enriched air or mixtures of air and retorting flue gas can be used for either air supply 19 or 22.

A flame sensor 24 is also connected to the burner as hereinafter described to assure that ignition of the combustible gasses has occured and that heating of the oil shale is proceeding. Thermocouples may also be provided in the burner and a thermocouple measuring circuit 26 is also connected through the umbilical 21.

Figure 2:
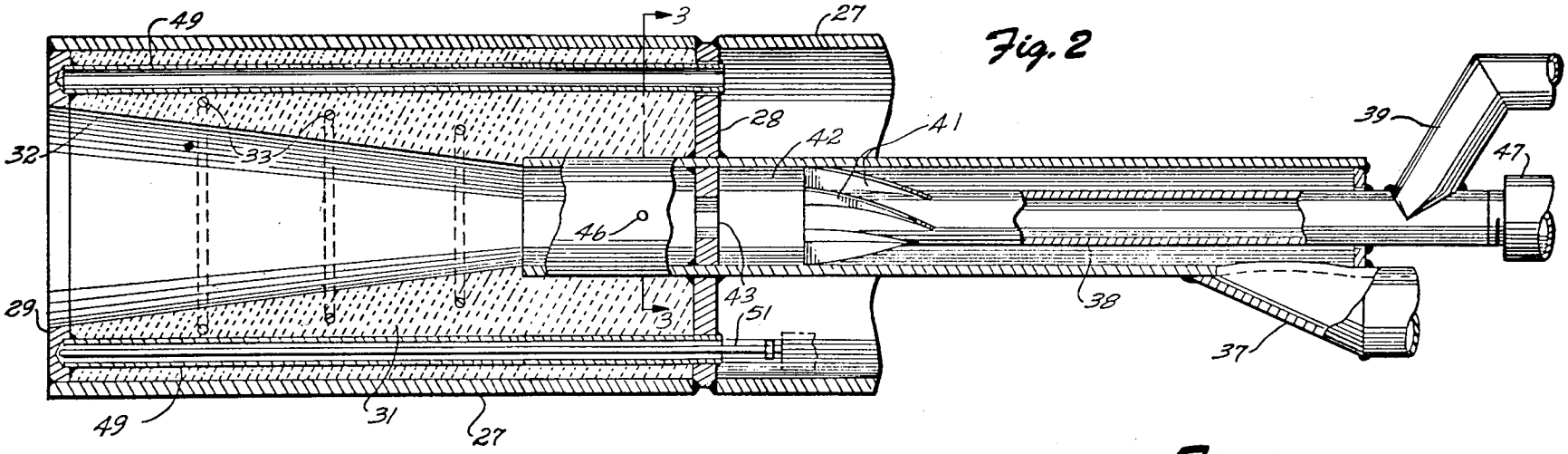
FIG. 2 illustrates in longitudinal cross section a burner constructed according to principles of this invention.

FIG. 2 illustrates in longitudinal cross section a presently preferred embodiment of burner useful in practice of this invention. As illustrated in this embodiment the burner has a cylindrical housing 27 which in a typical embodiment may simply be standard 8 inch steel pipe, although it may be desirable to form at least the lower end thereof of heat resistant stainless steel or the like. A steel bulkhead 28 is welded into the housing about 16 inches above the lower end and a ring 29 is welded in place at the lower end. A conventional castable refractory material 31, capable of withstanding elevated temperatures such as 3000° F. is cast in the space between the bulkhead 28 and ring 29. A conical exit nozzle 32 is formed along the axis of the refractory material with its larger end opening at the lower end of the burner. Steel reinforcing rings 33 are preferably embedded in the castable refractory to provide strength and integrity. The steel rings are conveniently held in place during casting of the refractory by radiating spiders (not shown) tack welded to the surrounding portion of the housing 27.

An outer feed tube 36 extends along the axis of the housing and has an open end welded into the bulkhead 28 to form an inlet for the nozzle 32. The other end of the outer feed tube 36 is closed and an air conduit 37 is welded into one side of the outer feed tube so that air for combustion in the burner can be introduced.

Gas is introduced to the burner through an inner feed tube 38 concentric with the outer tube. This tube extends upwardly or rearwardly through the closed end of the outer feed tube 36 and combustion gas is introduced through a side conduit 39. The lower end of the inner feed tube 38 is open. A series of helically extending vanes 41 are provided on the exterior of the inner tube 38 and serve to keep the lower end centered in the surrounding outer tube. These vanes also cause the air passing through the annulus between the tubes to be swirled for proper mixing with the combustible gas.

A mixing chamber 42 down stream from the open end of the inner tube 38 provides primary mixing of the swirling inlet air and the combustible gas. This mixture then passes through a smaller diameter orifice 43 where the enhanced velocity further assures turbulent mixing and retards propagation of flame to prevent flashback in the burner.

Figure 3:
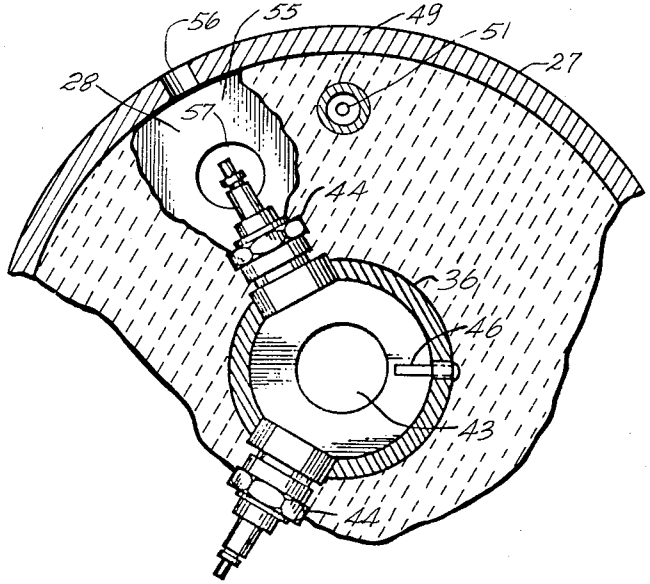
FIG. 3 is a transverse cross section of a portion of the burner at line 3—3.

A pair of conventional igniter plugs 44 (FIG. 3) and an anode pin 46 are provided down stream from the mixing orifice 43 and upstream from the inlet to the nozzle 32. Electrical discharge between the igniter plug and the anode assures ignition of the mixed gas in the burner. A pair of igniter plugs are provided for redundancy. The castable ceramic of the nozzle portion extends into the region surrounding the igniters to provide thermal protection of these elements. A cavity 55 (FIG. 3) is left in the ceramic around the uppermost portion of the igniter plugs so that the area is left free of refractory to avoid shorting out the spark plug wires. A pair of small holes 56 extend through the housing 27 adjacent the igniters and holes 57 are provided through the bulkhead 28 for fluid communication with the balance of the burner housing. This allows circulation of cooling air around the plugs as pointed out hereafter.

An ultraviolet light sensor 47 is mounted on the end of the inner feed tube 38 removed from the nozzle. The field of view of the sensor 47 is along the axis of the burner so that the region of the nozzle and rubble pile beyond the nozzle are monitored. The ultraviolet sensor is sensitive to wave lengths of radiation found in flame and is used to verify that ignition of the gas has occurred in the burner.

After ignition of the gas-air mixture in the burner, the ultraviolet light flame sensor monitors the burning to assure continued combustion and that there is no hazardous generation of quantities of unburned combustible mixture. Such ultraviolet sensors for detecting flames are commonly used and are conventionally available items.

These sensors require high voltages for operation and in field use it is quite inconvenient to bring the necessary high voltages down the utility umbilical 21. The transformer 48 (FIG. 1) for the ultraviolet light sensor is therefore mounted within the housing that is lowered down the hole. The flame sensor circuit 24 at the surface therefore transmits relatively low voltage power which is stepped up at the burner and the low voltage signal from the sensor is returned to the ground surface for monitoring by operating personnel. By transmitting the lower voltage power through the umbilical, fewer problems of radiation shielding which might interfere with thermocouple measurements are encountered. Transmission of lower voltage power for the igniters with a step up transformer 50 in the burner capsule is also preferred.

When the burner is used the igniters are actuated and air and gas are passed through the respective feed tubes 36 and 38. This mixture is ignited and a strong flame is directed out of the lower end of the burner to impinge on the top of the rubble pile in the oil shale retort. This burning is conducted until a substantial volume of oil shale has been heated above its ignition temperature so that the combustion in the rubble pile is self sustaining. This vast amount of heat would rapidly destroy the burner and elements within it if steps were not taken to keep it cool. Air from the supply 19 is therefore forced down the hole at a sufficient rate that the cool air flow around the burner 16 maintains it at a safe operating temperature.

Figure 4:
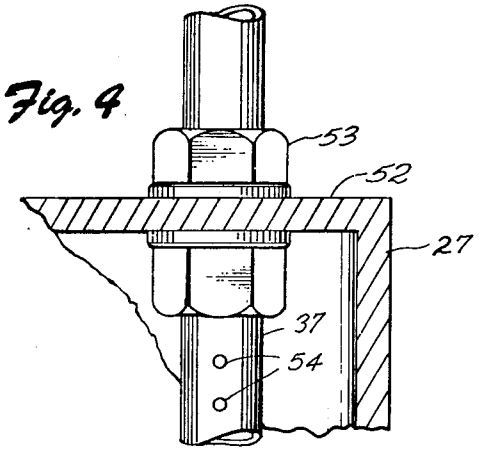
FIG. 4 is a fragmentary detail of the air line of the burner.
Figure 5:
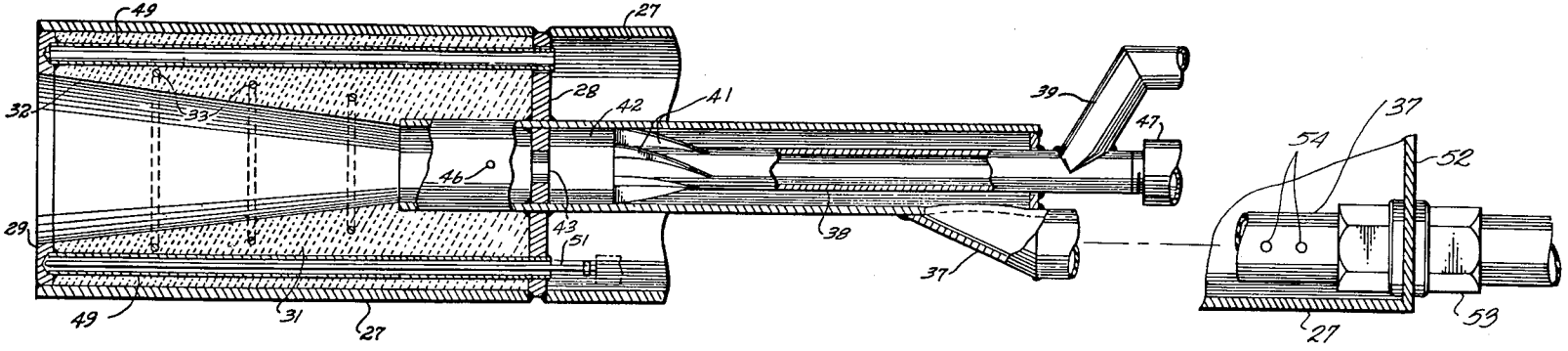
FIG. 5 is a composite of FIGS. 2 and 4.

Additional cooling of the burner is provided by bypassing a portion of the primary air from the air supply 22 (FIG. 1). FIG. 4 illustrates in fragmentary detail an upper portion of the cylindrical housing 27 where the primary air line 37 passes through the top bulkhead 52 of the burner. A conventional bulkhead fitting 53 connects the air line and it might be noted that an absolutely fluid tight seal is not required through the bulkhead. A pair of ¼ inch diameter holes 54 are formed through the wall of the air conduit inside the housing. Thus, a portion of the primary air "leaks" through the holes into the interior of the housing. The amount of air flow can readily be determined by conventional orifice formulas. FIG. 5 is a composite of FIGS. 2 and 4 indicating the location of the holes 54 adjacent the top bulkhead 52 of the burner.

A second pair of bleed holes 56 (FIG. 3) are provided through the wall of the housing by the igniters 44 near the bottom for the release of air. The air that flows from the housing mixes with the secondary air flowing around the burner. Thus, air is admitted to the top of the housing through the holes 54 and is bled out through the holes 56 so that there is circulation of air through the housing and around the various instruments therein. In effect, the support plates (not shown) for the instruments serve as baffles to help direct air flow and provide cooling in critical regions. The exit holes 56 are adjacent the igniters 44 so that there is good cooling of these elements and their lifetime is substantially prolonged.

Four tubes 49, equally spaced around the periphery, are welded between the ring 29 and bulkhead 28 so as to be closed at the lower end of the burner and open into the housing. A thermocouple 51 is positioned in each of the wells formed by these tubes 49 embedded in the refractory 31. These thermocouples monitor the temperature near the lower end of the burner where the most severe heating is encountered. This permits the operator to reduce the air and gas supply to the burner to lower the rate of heat generation or, if desirable, to increase the quantity of air flowing down the hole and around the burner to provide additional cooling.

It will be noted that the secondary air passed down the hole around the burner provides the oxygen for combustion of the carbonaceous material in the oil shale heated by the burner. It also carries heat of the flame into the bed of oil shale particles for heating a substantial volume of the bed. As heating of the shale continues, a greater portion of the total heat adjacent the top of the retort comes from combustion of carbonaceous materials as compared with the quantity of heat from the burner and eventually the combustion in the retort becomes self sustaining. At this point the burner can be turned off and withdrawn from the hole and retorting conducted in the normal manner with air or other gas passed down the hole 13.

Although but a single embodiment of this invention has been described and illustrated herein, many modifications and variations will be apparent to one skilled in the art. Thus, for example, the relative proportions of the elements of the burner can be modified appreciably to provide for combustion of gas having a lower fuel value than the butane-propane mixture for which the illustrated burner was designed. In such a case it may be desirable to bring a larger volume combustible gas supply to the annulus between the outer feed tube and inner feed tube and bring the air through the inner feed tube. Similarly, it will be apparent that if a substantial area of retort is involved it may be preferable to have a plurality of bore holes to the top of the rubble pile so that ignition is obtained at several points and the distance for lateral propagation of the flame front in the retort is minimized. Techniques other than the described reaming may be used for forming the plenum at the top of the rubble pile. Many other modifications and variations will be apparent to one skilled in the art and it is therefore to be understood that within the scope of the appended claims the invention may be practiced otherwise than as specifically described.

What is claimed is:

1. A burner for remote ignition of a combustible material comprising:

an elongated cylindrical housing having a gas inlet end and a flame exit end;

a refractory exit nozzle having a generally conical passage therethrough coaxial with the housing and flaring outwardly from an inlet end to a larger outlet end opening at the flame exit end of the housing;

an outer feed tube, coaxial with the housing, having one end remote from the exit nozzle and another end connected to the inlet end of the exit nozzle for directing gas into the exit nozzle;

an inner feed tube coaxial with the outer feed tube and extending therethrough from the end remote from the exit nozzle, and having an outlet end spaced apart from the inlet end of the exit nozzle for providing a gas mixing region in the outer feed tube adjacent the outlet end of the inner feed tube;

means for introducing gases into the inner feed tube and into the annulus between the inner and outer feed tubes for flow towards the exit nozzle;

means downstream from the outlet end of the inner feed tube for igniting a mixture of gases;

a radiation sensitive flame sensor means mounted at a position remote from the outlet end and coaxially with the inner feed tube for viewing into the inlet end of the exit nozzle for sensing presence of a flame therein; and a thermocouple well in the refractory exit nozzle for accommodating a temperature measuring thermocouple.

2. A burner as defined in claim 1 wherein the means for introducing gases comprises means for passing air through the annulus between the inner and outer feed tubes and means for passing a combustible gas through the inner feed tube.

3. A burner as defined in claim 2 further comprising a plurality of generally helically extending vanes in the annulus between the inner feed tube and outer feed tube, at the outlet end of the inner feed tubes, for causing air passing therethrough to be swirled.

4. A burner as defined in claim 3 wherein the gas mixing region comprises a chamber downstream from the outlet end of the inner feed tube and from the vanes, and orifice means in the outer feed tube downstream from the chamber, said orifice means having a smaller area opening therethrough than the transverse cross-sectional area of the chamber.

5. A burner for remote ignition of a combustible material comprising:

an elongated cylindrical housing having a gas inlet end and a flame exit end;

a refractory exit nozzle having a generally conical passage therethrough coaxial with the housing and flaring outwardly from an inlet end to a larger outlet end opening at the flame exit end of the housing;

an outer feed tube, coaxial with the housing, having one end remote from the exit nozzle and another end connected to the inlet end of the exit nozzle for directing gas into the exit nozzle;

an inner feed tube coaxial with the outer feed tube and extending therethrough from the end remote from the exit nozzle, and having an outlet end spaced apart from the inlet end of the exit nozzle for providing a gas mixing region in the outer feed tube adjacent the outlet end of the inner feed tube;

means for introducing gases into the inner feed tube and into the annulus between the inner and outer feed tubes for flow towards the exit nozzle;

means downstream from the outlet end of the inner feed tube for igniting a mixture of gases; and a radiation sensitive flame sensor means, comprising an ultraviolet light sensor means mounted on the inner feed tube at a position remote from the exit nozzle and coaxially with the inner tube for viewing into the inlet end of the exit nozzle for sensing presence of a flame therein; and power supply means for the ultraviolet sensor mounted in the housing.

6. A burner for remote ignition of a combustible material comprising:

an elongated cylindrical housing having a gas inlet end and a flame exit end, including support means to permit positioning the housing in an underground hole;

a refractory exit nozzle, coaxial with the housing, having an inlet end and having an outlet end opening at the flame exit end of the housing;

an outer feed tube, coaxial with the housing, having one end remote from the exit nozzle and another end connected to the inlet end of the exit nozzle for directing gas into the exit nozzle;

an inner feed tube, coaxial with the outer feed tube and extending therethrough from the end remote from the exit nozzle, and having an outlet end spaced apart from the inlet end of the exit nozzle for providing a gas mixing region in the outer feed tube adjacent the outlet end of the inner feed tube;

means for introducing gases into the inner feed tube and into the annulus between the inner and outer feed tubes, for flow towards the exit nozzle;

means downstream from the outlet end of the inner feed tube for igniting a mixture of gases;

a radiation sensitive flame sensor means mounted at a position remote from the outlet end and coaxially with the inner feed tube for viewing into the inlet end of the exit nozzle for sensing presence of a flame therein;

means for introducing air into the housing near the gas inlet end of the housing; and means for exhausting air from the housing near the flame exit end of the housing for cooling the interior thereof.

7. A burner as defined in claim 6 wherein the means for introducing air into the housing comprises orifice means in the means for introducing gas to the annulus between the inner and outer feed tubes.

8. A burner as defined in claim 7 wherein the means for exhausting air from the housing comprises orifice means in the housing, adjacent the means for igniting the mixture of gases, for cooling thereof.

9. A burner for ignition of a combustible material, which comprises:

a housing having a gas inlet end and a flame exit end;

support means connected to the housing for positioning the housing for ignition of a combustible material;

refractory means in said housing adjacent the exit end of the housing and having an inlet end and an exit end with a passageway therebetween for directing flame therethrough and out the exit end of the housing;

an outer feed tube in the housing connected to the inlet end of the refractory means for directing gas into the inlet end of the refractory means;

an inner tube, coaxial with the outer tube, extending through the outer tube and having an outlet end spaced apart from the inlet end of the refractory means for forming a mixing zone in the outer tube for gases directed into the inlet end of the refractory means through the annulus between the inner tube and the outer tube and gases introduced into the mixing zone through the inner tube;

means mounted in the refractory means for igniting a combustible gaseous mixture directed through the refractory means;

means in the housing for introducing air into the gas inlet end of the housing between the housing and the outer tube;

means in the housing for exhausting air from the housing near the inlet end of the refractory means whereby air introduced into the gas inlet end of the housing and exhausted through the housing near the inlet end of the refractory means has a cooling effect on the portion of the burner above the refractory means; and radiation sensitive flame sensor means mounted at a position remote from the outlet end and coaxially with the inner tube for viewing into the inlet end of the refractory means for sensing presence of flame therein.

* * * * *